US006109070A

United States Patent [19]

Chen

[11] Patent Number: 6,109,070

[45] Date of Patent: Aug. 29, 2000

[54] BATH GLOVE

[76] Inventor: Kuo-Chin Chen, 2-1 Fl., No. 18, Alley 47, Lane 208, Jui An Street, Ta An District, Taipei, Taiwan

[21] Appl. No.: 09/196,887

[22] Filed: Nov. 20, 1998

[51] Int. Cl.[7] ..... D04B 9/58; A41D 19/00

[52] U.S. Cl. ..... 66/174; 2/158; 2/159

[58] Field of Search ..... 2/67, 158, 159, 2/161.8, 167, 169; 66/169 R, 170, 171, 174, 194, 202; 139/383 R, 384 R, 383 B

[56] References Cited

U.S. PATENT DOCUMENTS

| | | | |
|---|---|---|---|
| 1,766,365 | 6/1930 | Weiss et al. | 2/158 |
| 2,151,448 | 3/1939 | Steinberg | 2/158 |
| 2,342,547 | 2/1944 | Kuehnel | 66/174 |
| 3,711,889 | 1/1973 | Jennings | 2/158 |
| 4,670,930 | 6/1987 | Lu | 2/118 |
| 4,980,943 | 1/1991 | Barber | 2/158 |

*Primary Examiner*—Larry Worrell, Jr.

*Attorney, Agent, or Firm*—Pro-Techtor International Services

[57] ABSTRACT

Disclosed is a bath glove woven out of yarns formed from twisted artificial fibers. The yarns are hooked and pulled in specific manner to form bottom, middle, and top layers of yarns. The bottom layer of yarns form loops to sequentially tighten the middle and top layers of yarns at predetermined intervals, such that parts of the yarns of middle and top layers between two adjacent points tightened together by the loops of the bottom yarns become loosely and upward projected. The top layer of yarns are guided in the course of weaving to loosely wind round an upper part of the upward projected portions of the middle layer of yarns, such that a difference in height exists between the middle and top layers of yarns to form a wavy, elastic and fluffy texture of the bath glove that traps more bubbles for better cleaning and massaging effect without undesirably scratching skin.

2 Claims, 3 Drawing Sheets

BATH GLOVE

BACKGROUND OF THE INVENTION

The present invention relates to an improved glove, and more particularly to an improved bath glove.

There are various kinds of body cleansing means available in the market of bathing supplies. Apart from common bath towels and back brushes, specially designed bath gloves are now very popular items. Such bath glove can be put on one hand to directly scrub and clean a user's body.

FIGS. 1 and 2 are perspective and fragmentary, enlarged plan views, respectively, of a conventional bath glove. As shown, the conventional bath glove is simply woven out of artificial fibers 1 in normal stitch patterns, such as garter stitches. With such stitches, meshes or spaces 2 among the fibers 1 are arranged in an ordered form. It is the rough surface of the bath glove formed from the woven artificial fibers 1 and the meshes 2 that scrubs and cleans a user's skin.

Following are some disadvantages of the above-described conventional bath glove:

1. The rough surface of the bath glove formed from the woven artificial fibers 1 and meshes 2 among the fibers has coarse texture that tends to undesirably scratch and even hurt the skin.
2. The meshes 2 formed from, for example, garter stitches are too large to hold sufficient amount of body cleanser or soap liquid therein to produce rich bubbles. Therefore, increased amount of body cleanser and soap must be added in the course of bathing and that is inconvenient and not economical.
3. The bath glove does not easily hold bubbles produced by body cleanser or soap and therefore has reduced cleansing effect.

It is therefore desirable to develop a bath glove having fine, supple, and fluffy texture that has good ability to hold sufficient cleanser and produce rich bubbles to effectively clean the skin without hurting it.

SUMMARY OF THE INVENTION

A primary object of the present invention is to provide a bath glove having large meshes and supple and fluffy texture to hold rich bubbles for thoroughly cleaning skin with reduced amount of cleanser or soap.

Another object of the present invention is to provide a bath glove having supple and fluffy texture to protect skin against undesirable scratch.

A further object of the present invention is to provide a bath glove having supple and fluffy texture to massage skin while cleaning it.

To achieve the above and other objects, the present invention provides a bath glove woven out of yarns formed from twisted artificial fibers. The yarns are woven in specific manner into the shape of a glove such that the glove includes bottom, middle, and top layers of yarns. The yarns of bottom layer form multiple loops to sequentially tighten yarns in the middle and top layers at predetermined intervals, such that parts of yarns of the middle and the top layers between two adjacent points tightened together by the loops of the bottom yarns become loosely and upward projected, giving the bath glove a fluffy surface.

The bath glove of the present invention is characterized in that the yarns of top layer are guided in the course of weaving to loosely wind round an upper part of the upward projected portion of the middle layer of yarns, such that a difference in height exists between the upward projected middle and top layers of yarns to form a continuous, wavy, supple, elastic and fluffy texture of the bath glove.

BRIEF DESCRIPTION OF THE DRAWINGS

The objects, features, and performance of the present invention may be best understood by referring to the following detailed description of the preferred embodiments and the accompanying drawings, wherein.

DETAILED DESCRIPTION OF THE PREFERRED EMBODIMENTS

Figure 1:
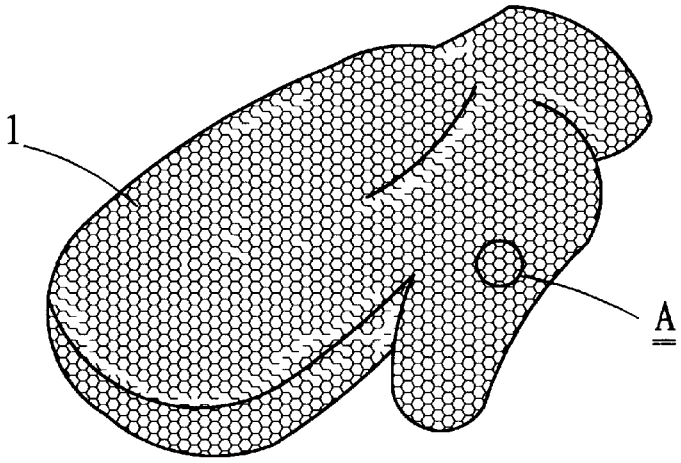
(PRIOR ART) FIG. 1
FIG. 1 shows a conventional bath glove.
Figure 2:
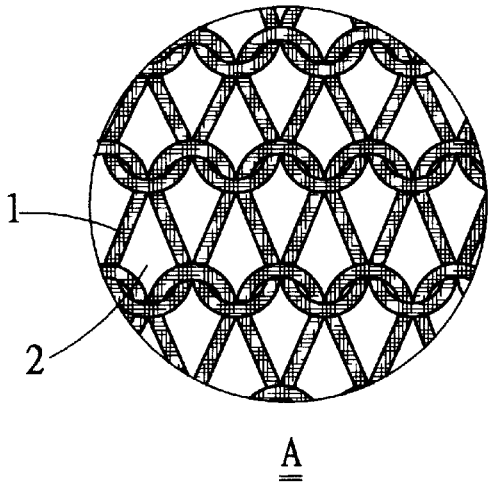
(PRIOR ART) FIG. 2
FIG. 2 is a fragmentary, enlarged plan view of FIG. 1.
Figure 3:
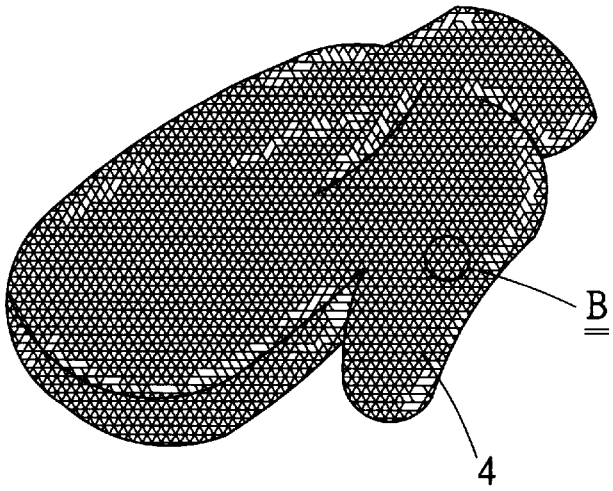
FIG. 3 shows a bath glove according to the present invention.
Figure 4:
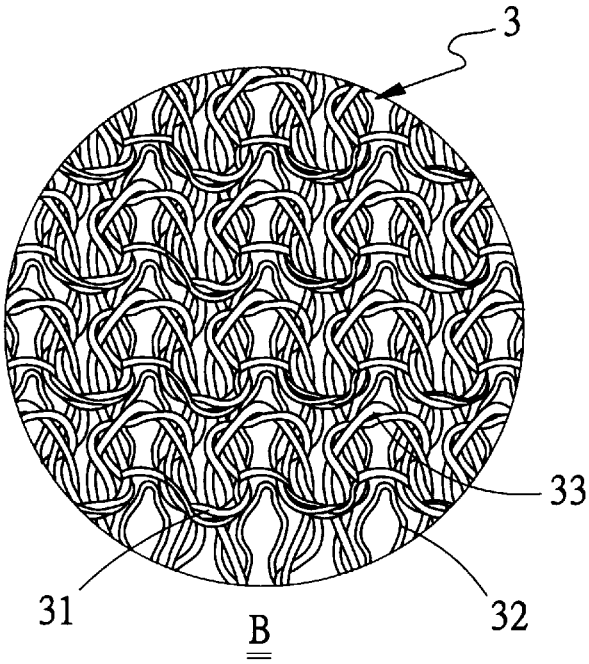
FIG. 4 is a fragmentary, enlarged plan view of FIG. 3.

Please refer to FIGS. 3 and 4 that are perspective view and fragmentary and enlarged plan view, respectively, of a bath glove according to the present invention. As shown, the bath glove of the present invention is uniquely woven out of yarns 3 formed from twisted artificial fibers. Multiple artificial fibers and at least a nylon thread are used to form each yarn 3 for weaving the bath glove. The yarns 3 are hooked and pulled in a predetermined manner such that a bottom layer of yarns 31, a middle layer of yarns 32, and a top layer of yarns 33 are formed. The middle layer of yarns 32 is formed mainly by hooking and pulling the nylon thread in the yarn 3 in a manner such that the bottom layer of yarns 31 secures bases of a series of intermediate height loops that form the middle layer 32. The bottom layer of yarns 31 also secures the bases of a series of higher loops that form the top layer of yarns 33. The yarns 3 forming the bottom layer 31 form loops to sequentially tighten the middle layer of yarns 32 and the top layer of yarns 33 at predetermined intervals, such that parts of yarns of the middle and the top layers 32, 33 between two adjacent points tightened together by the loops of the bottom yarns 31 become loosely and upward projected. The yarns 33 of the top layer are guided in the course of weaving to loosely wind round an upper part of the upward projected portions of the middle layer of yarns 32, such that a difference in height exists between the upward projected middle and top layers of yarns 32, 33 to form a continuous, wavy, supple, elastic and fluffy texture 4 for the bath glove.

Figure 5:
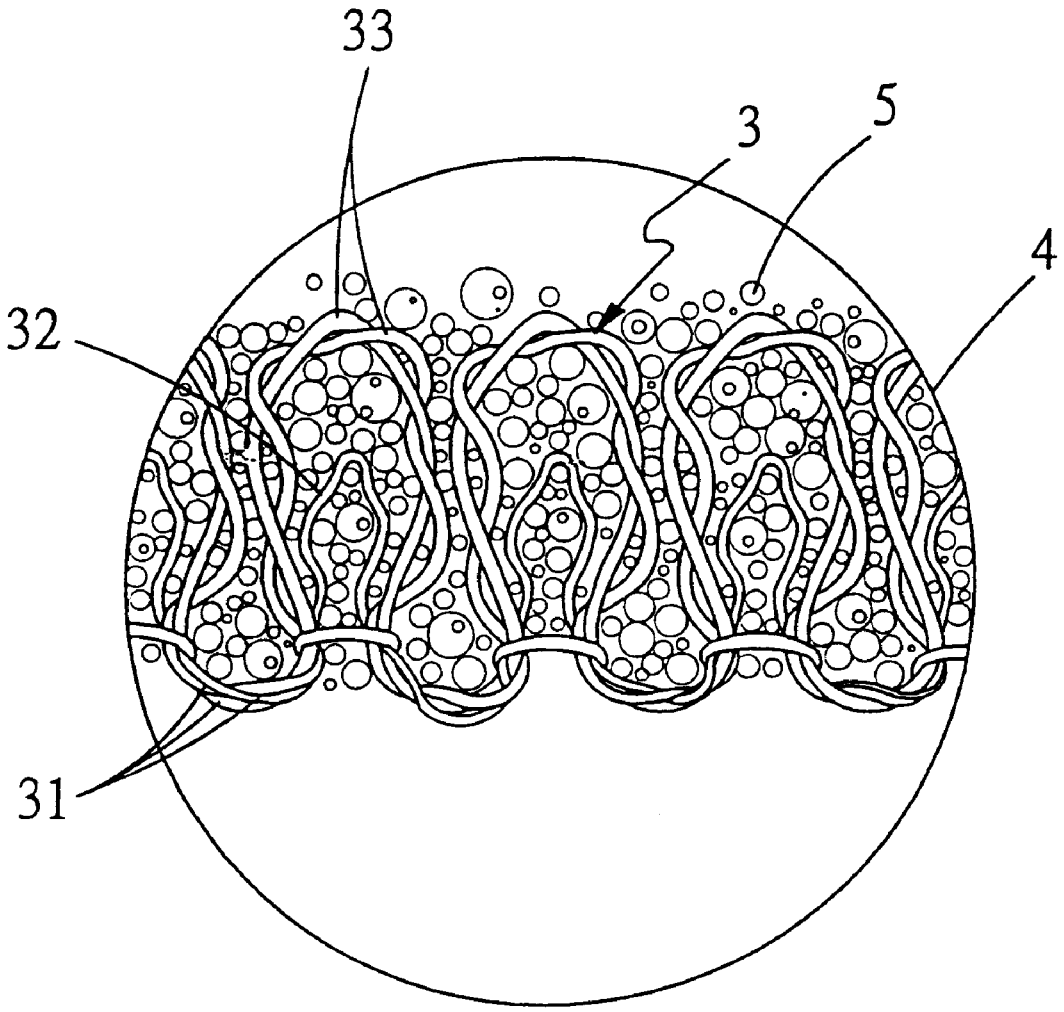
FIG. 5 is a fragmentary, enlarged side view illustrating the bath glove of the present invention in use.

Please now refer to FIG. 5 that is a fragmentary, enlarged side view of the texture 4 of the bath glove woven in the above-described manner. As shown, the top and middle layers of yarns 32, 33 form a continuous, elastic and fluffy texture 4 that enables better attachment of bubbles 5 to the surface of the bath glove and therefore a better cleaning effect can be achieved while a reduced amount of body cleanser or soap is needed. Moreover, the elastic and fluffy texture 4 gently massages skin without scratching and hurting it.

By using nylon threads as the middle layer of yarns 32, the texture 4 shall have better elasticity to maintain prolonged fluffy nature thereof and provide better massaging effect. The nylon thread also provides pleasantly bright visual effect.

In conclusion, the present invention has following features and advantages:

1. The wavy and continuous fluffy texture 4 formed from the middle and top layers of yarns 32, 33 allows good attachment of bubbles 5 to the bath glove of the present invention for thoroughly cleaning skin with reduced amount of body cleanser or soap.

2. The wavy and continuous fluffy texture 4 and accordingly, the bath glove provide good massaging effect on skin.

3. The wavy and continuous fluffy texture 4 and accordingly, the bath glove protect skin against undesirable scrubbing and injury.

4. The nylon threads forming the middle layer of yarns 32 have better elasticity and give the bath glove good suppleness and fluffy state for better massaging effect and pleasantly bright visual effect.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A bath glove woven out of yarns formed from multiple twisted artificial fibers, said bath glove comprises:

a bottom layer of yarns, a middle layer of yarns, and a top layer of yarns, said bottom layer of yarns secures a plurality of bases of said middle layer of yarns so as to form a first series of upward projecting loops, said bottom layer of yarns also secures a plurality of bases of said top layer of yarns so as to form a second series of upward projecting loops, each of the loops in said second series of loops is larger than said loops in said first series of loops; said layers of loops provide said bath glove with a continuous, wavy, supple, elastic and fluffy texture to hold rich bubbles to achieve an enhanced cleaning and massaging effect while protecting skin against undesired scratching.

2. The bath glove as claimed in claim 1, wherein:

said middle layer of yarns comprises at least one nylon thread that provides said bath glove with elasticity.

* * * * *